US009008529B2

(12) United States Patent
Kiuchi

(10) Patent No.: US 9,008,529 B2
(45) Date of Patent: Apr. 14, 2015

(54) IMAGE FORMING APPARATUS, IMAGE FORMING SYSTEM, NON-TRANSITORY COMPUTER READABLE MEDIUM, AND IMAGE FORMING METHOD

(71) Applicant: Fuji Xerox Co., Ltd., Tokyo (JP)

(72) Inventor: Yutaka Kiuchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/935,772

(22) Filed: Jul. 5, 2013

(65) Prior Publication Data

US 2014/0147148 A1 May 29, 2014

(30) Foreign Application Priority Data

Nov. 27, 2012 (JP) ..... 2012-258673

(51) Int. Cl.
*G03G 15/20* (2006.01)
*G03G 15/00* (2006.01)

(52) U.S. Cl.
CPC ..... *G03G 15/2046* (2013.01); *G03G 15/6591* (2013.01); *G03G 2215/00502* (2013.01); *G03G 2215/2032* (2013.01)

(58) Field of Classification Search
None
See application file for complete search history.

(56) References Cited

U.S. PATENT DOCUMENTS

2011/0064436 A1 * 3/2011 Kimura et al. ..... 399/67

FOREIGN PATENT DOCUMENTS

| | | | | |
|---|---|---|---|---|
| JP | A-6-51669 | | 2/1994 | |
| JP | A-2003-98717 | | 4/2003 | |
| JP | 2006-220694 | * | 8/2006 | ..... G03G 15/01 |
| JP | A-2006-220694 | | 8/2006 | |
| JP | A-2008-97041 | | 4/2008 | |
| JP | A-2009-134060 | | 6/2009 | |
| JP | A-2010-107540 | | 5/2010 | |

* cited by examiner

*Primary Examiner* — Clayton E Laballe
*Assistant Examiner* — Jas Sanghera
(74) *Attorney, Agent, or Firm* — Oliff PLC

(57) ABSTRACT

An image forming apparatus includes a fixing unit. The fixing unit performs a fixing process selectively using a first fixing energy and a second fixing energy. The first fixing energy is used for a transparent recording medium having thereon an image and a light-shielding layer superposed on the image, the light-shielding layer being substantially impervious to light. The second fixing energy is used for a transparent recording medium having the image thereon but not having the light-shielding layer thereon. The first fixing energy is lower than the second fixing energy.

17 Claims, 15 Drawing Sheets

IMAGE FORMING APPARATUS, IMAGE FORMING SYSTEM, NON-TRANSITORY COMPUTER READABLE MEDIUM, AND IMAGE FORMING METHOD

CROSS-REFERENCE TO RELATED APPLICATIONS

This application is based on and claims priority under 35 USC 119 from Japanese Patent Application No. 2012-258673 filed Nov. 27, 2012.

BACKGROUND (i) Technical Field

The present invention relates to image forming apparatuses, image forming systems, non-transitory computer readable media, and image forming methods.

(ii) Related Art

Some copiers, printers, fax machines, or image forming apparatuses having functions of these apparatuses employ the electrophotographic image forming technology.

According to the electrophotographic image forming technology, a following process is performed. An electrostatic latent image is formed on the surface of a photoconductor drum by irradiating the surface of the photoconductor drum with a laser beam. Toner is supplied onto the electrostatic latent image from a developing device to form a toner image. The toner image on the surface of the photoconductor drum is transferred onto a recording medium. The transferred toner image is then fixed to the recording medium by a fixing device.

SUMMARY

According to an aspect of the invention, there is provided an image forming apparatus including a fixing unit. The fixing unit performs a fixing process selectively using a first fixing energy and a second fixing energy. The first fixing energy is used for a transparent recording medium having thereon an image and a light-shielding layer superposed on the image, the light-shielding layer being substantially impervious to light. The second fixing energy is used for a transparent recording medium having the image thereon but not having the light-shielding layer thereon. The first fixing energy is lower than the second fixing energy.

BRIEF DESCRIPTION OF THE DRAWINGS

Exemplary embodiments of the present invention will be described in detail based on the following figures, wherein:

FIG. 10A is a sectional view of a portion of a transparent film with a light-shielding layer, the transparent film having undergone a fixing process in which a fixing energy E1 is used, whereas

FIG. 12, is a sectional view of the portion of the intermediate transfer belt of the image forming apparatus illustrated in FIG. 3 during the image forming process;

FIG. 13, is a sectional view of the portion of the intermediate transfer belt of the image forming apparatus illustrated in FIG. 3 during the image forming process;

FIG. 14, is a sectional view of the portion of the intermediate transfer belt of the image forming apparatus illustrated in FIG. 3 and of the portion of the transparent film during the image forming process;

FIG. 15, is a sectional view of the portion of the transparent film during the image forming process;

FIG. 22, is a sectional view of the portion of the intermediate transfer belt of the image forming apparatus illustrated in FIG. 3 and the portion of the transparent film during the image forming process;

FIG. 23, is a sectional view of the portion of the transparent film during the image forming process;

FIG. 24, is a sectional view of the portion of the intermediate transfer belt of the image forming apparatus illustrated in FIG. 3 during the image forming process;

FIG. 25, is a sectional view of the portion of the intermediate transfer belt of the image forming apparatus illustrated in FIG. 3 and the portion of the transparent film during the image forming process;

FIG. 26, is a sectional view of the portion of the transparent film during the image forming process.

DETAILED DESCRIPTION

Figure 1:
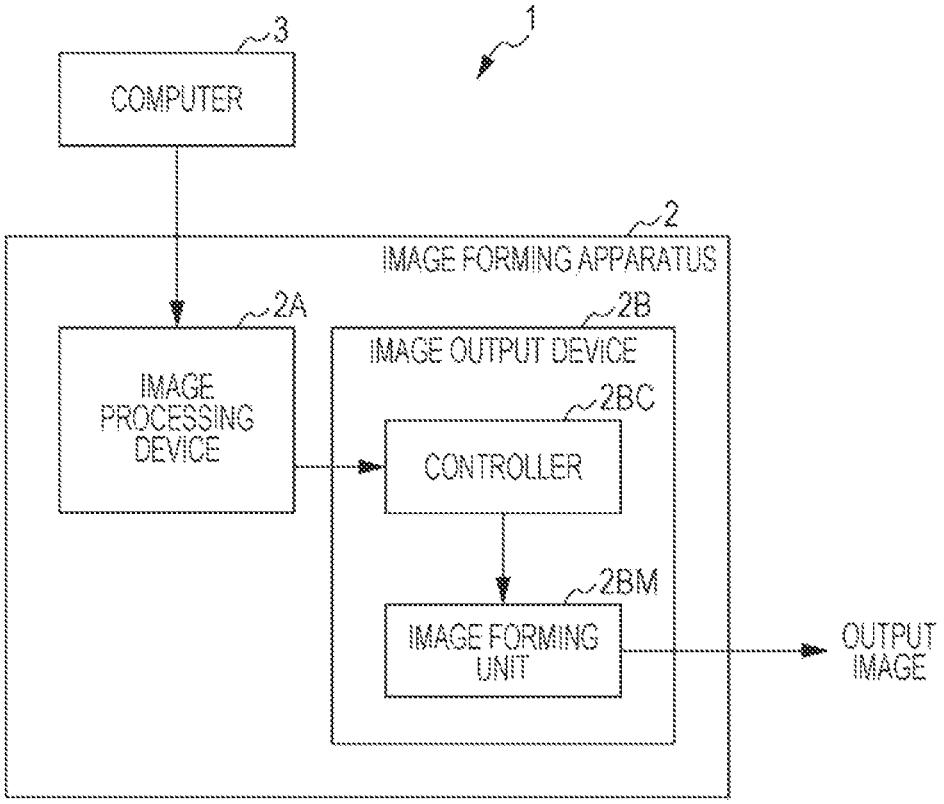
FIG. 1 illustrates an example of an image forming system according to an exemplary embodiment of the present invention.

Exemplary embodiments of the present invention will be described in detail below with reference to the accompanying drawings by way of example. Note that similar components are generally denoted by similar reference numerals throughout the drawings used for describing the exemplary embodiments, and a repeated description thereof is omitted.

First Exemplary Embodiment

FIG. 1 illustrates an example of an image forming system 1 according to a first exemplary embodiment.

The image forming system 1 includes an image forming apparatus 2 and a computer 3.

The image forming apparatus 2 includes an image processing device 2A and an image output device 2B. The image forming apparatus 2 performs an image processing process and an image forming process on the basis of image data accepted from the computer 3.

The image processing device 2A of the image forming apparatus 2 performs predetermined image processing, for example, analog/digital (A/D) conversion, color density correction, and shading correction, on image data accepted from the computer 3.

The image output device 2B of the image forming apparatus 2 includes a controller 2BC and an image forming unit 2BM.

The controller 2BC of the image output device 2B outputs image data supplied from the image processing device 2A and an instruction to start an image forming process to the image forming unit 2BM.

The image forming unit 2BM of the image output device 2B has an image forming function. In accordance with an instruction to start an image forming process, the image forming unit 2BM performs an image forming process on the basis of accepted image data and, as a result of this image forming process, outputs a transparent film or the like on which an image has been formed.

Figure 2:
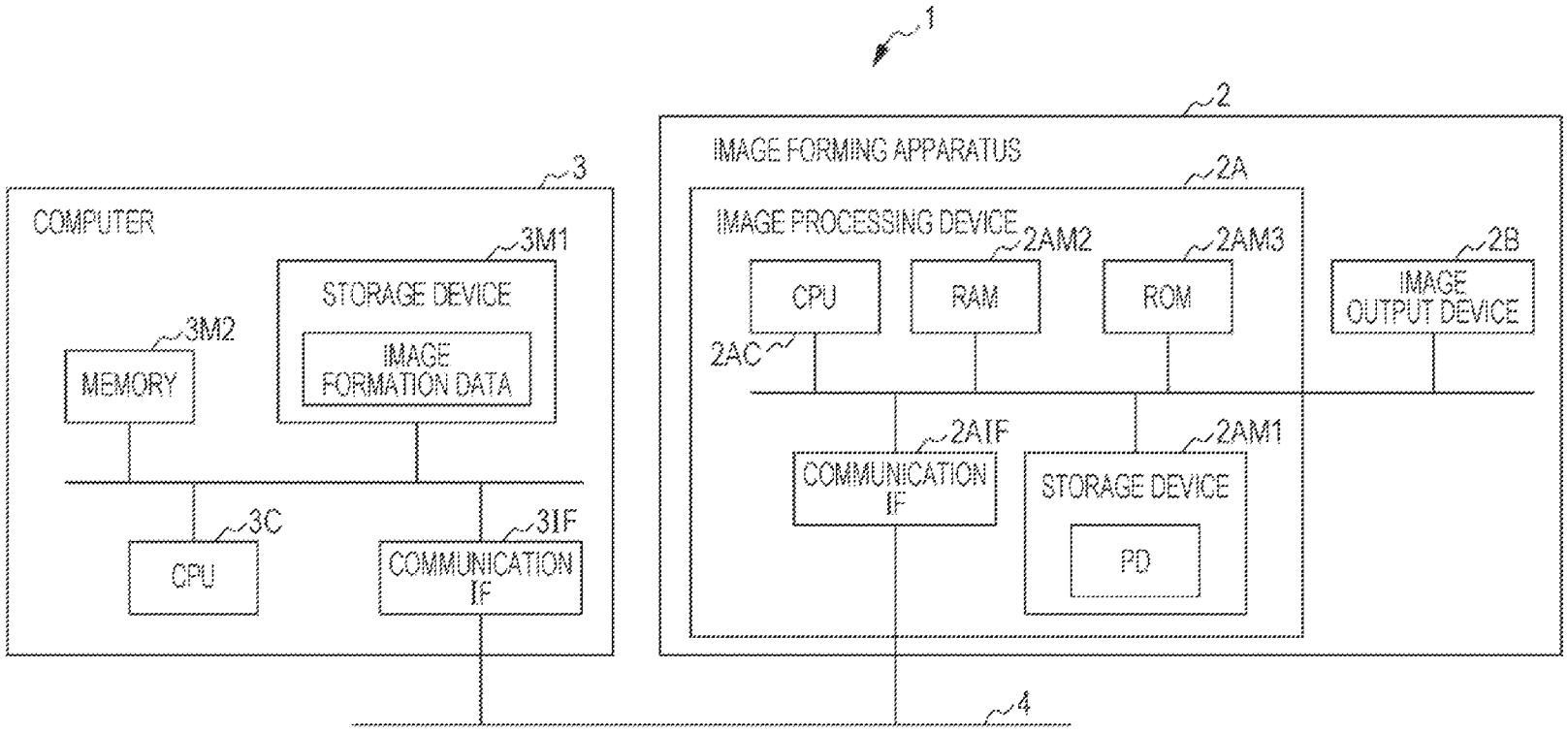
FIG. 2 illustrates the image forming system of FIG. 1 in terms of functions thereof.

FIG. 2 illustrates the image forming system 1 of FIG. 1 in terms of functions thereof.

The image forming system 1 includes the image forming apparatus 2 and the computer 3 that are connected to each other via a communication line 4.

The computer 3 functions as a processing apparatus (client apparatus). The computer 3 includes a central processing unit (CPU) 3C, a storage device 3M1 such as a hard disk drive, a memory 3M2 such as a random access memory (RAM), and a communication interface (hereinafter, referred to as a communication IF) 3IF.

The storage device 3M1 stores application software for generating a document and for issuing an image formation request; a printer driver; and various kinds of image data such as page description language (PDL) data.

The memory 3M2 stores a program and data that are read from the storage device 3M1.

The communication IF 3IF is an interface that exchanges data with the image forming apparatus 2 via the communication line 4.

The CPU 3C controls the computer 3. For example, the CPU 3C loads a printer driver into the memory 3M2 from the storage device 3M1 and executes the printer driver. As a result of this, image data (such as PDL data) is sent to the image forming apparatus 2.

The image processing device 2A of the image forming apparatus 2 includes a CPU 2AC, a storage device 2AM1 such as a hard disk drive, a RAM 2AM2, a read only memory (ROM) 2AM3, and a communication IF 2AIF.

The storage device 2AM1 stores various kinds of data and various programs necessary for performing an image forming process, such as an image processing program (an example of an image processing program) PD which is software.

The image processing program PD includes programs (software) for implementing individual functions of a PDL interpreting unit (not illustrated); a rendering unit (not illustrated); an image data analyzing unit (not illustrated); and an image processing unit (not illustrated), specifically a color conversion unit (not illustrated), a gradation correction unit (not illustrated), and a halftone-dot generation unit (not illustrated), of the image processing device 2A.

The ROM 2AM3 stores data necessary for image processing, such as color range information and default values of a color parameter, a gradation parameter, and a halftone-dot parameter.

The RAM 2AM2 stores the image processing program PD read from the storage device 2AM1 and image data received via the communication IF 2AIF.

Also, in the RAM 2AM2, at least a storage area (a) and a storage area (b) are allocated in addition to a storage area for storing image data and a storage area for storing rendered data.

The storage area (a) is a storage area that functions as a color parameter storage unit (not illustrated) of the color conversion unit, a gradation parameter storage unit (not illustrated) of the gradation correction unit, and a halftone-dot parameter storage unit (not illustrated) of the halftone-dot generation unit (a storage area for storing default values of individual parameters). That is, the storage area (a) is a storage area for storing parameters that are loaded from the ROM 2AM3 as default values.

The storage area (b) is a storage area for storing individual processing steps and processing results of color conversion processing, gradation correction processing, and screen processing.

The CPU 2AC controls the image forming apparatus 2. For example, the CPU 2AC loads the image processing program PD into the RAM 2AM2 from the storage device 2AM1 and executes the image processing program PD, thereby generating image data and outputting the image data to the image output device 2B.

The communication IF 2AIF is an interface that exchanges data with the computer 3 via the communication line 4. For example, the communication IF 2AIF receives image data sent from the computer 3.

Examples of the communication line 4 include a wired communication line, such as a local area network (LAN) or a telephone line; a wireless communication line, such as a wireless LAN; and combinations of these communication lines.

The case has been described here in which the image processing program PD including programs that implement individual functions of the image processing device 2A and represent processing procedures of the image processing is recorded in the storage device 2AM1, such as a hard disk drive serving as a recording medium. However, the image processing program PD may be provided in the following manner.

Specifically, the image processing program PD may be stored in the ROM 2AM3, and the CPU 2AC may load the image processing program PD from this ROM 2AM3 into the storage device 2AM1 or the RAM 2AM2 and execute the image processing program PD.

Alternatively, the image processing program PD may be stored on a computer readable recording medium, such as a digital versatile disc ROM (DVD-ROM), a compact disc ROM (CD-ROM), a magneto-optical disk (MO), or a flexible disk, and be distributed. In this case, the image processing device 2A installs thereinto the image processing program PD recorded on the recording medium and the CPU 2AC then executes this image processing program PD. The image processing program PD may be installed into a memory such as the RAM 2AM2, or the storage device 2AM1 such as a hard disk drive. The image processing device 2A loads the image processing program PD stored in such a storage device to the storage device 2AM1 and executes the image processing program PD as needed.

Alternatively, the image processing device 2A may be connected to a server apparatus or a computer such as a host computer via a communication line (for example, the Internet). The image processing device 2A may download the image processing program PD from the server apparatus or the computer, and then execute the image processing program PD. In this case, the image processing program PD may be downloaded to a memory such as the RAM 2AM2 or the storage device 2AM1 such as a hard disk drive. The image processing device 2A may load the image processing program PD stored in such a storage device into the storage device 2AM1 and execute the image processing program PD as needed.

Figure 3:
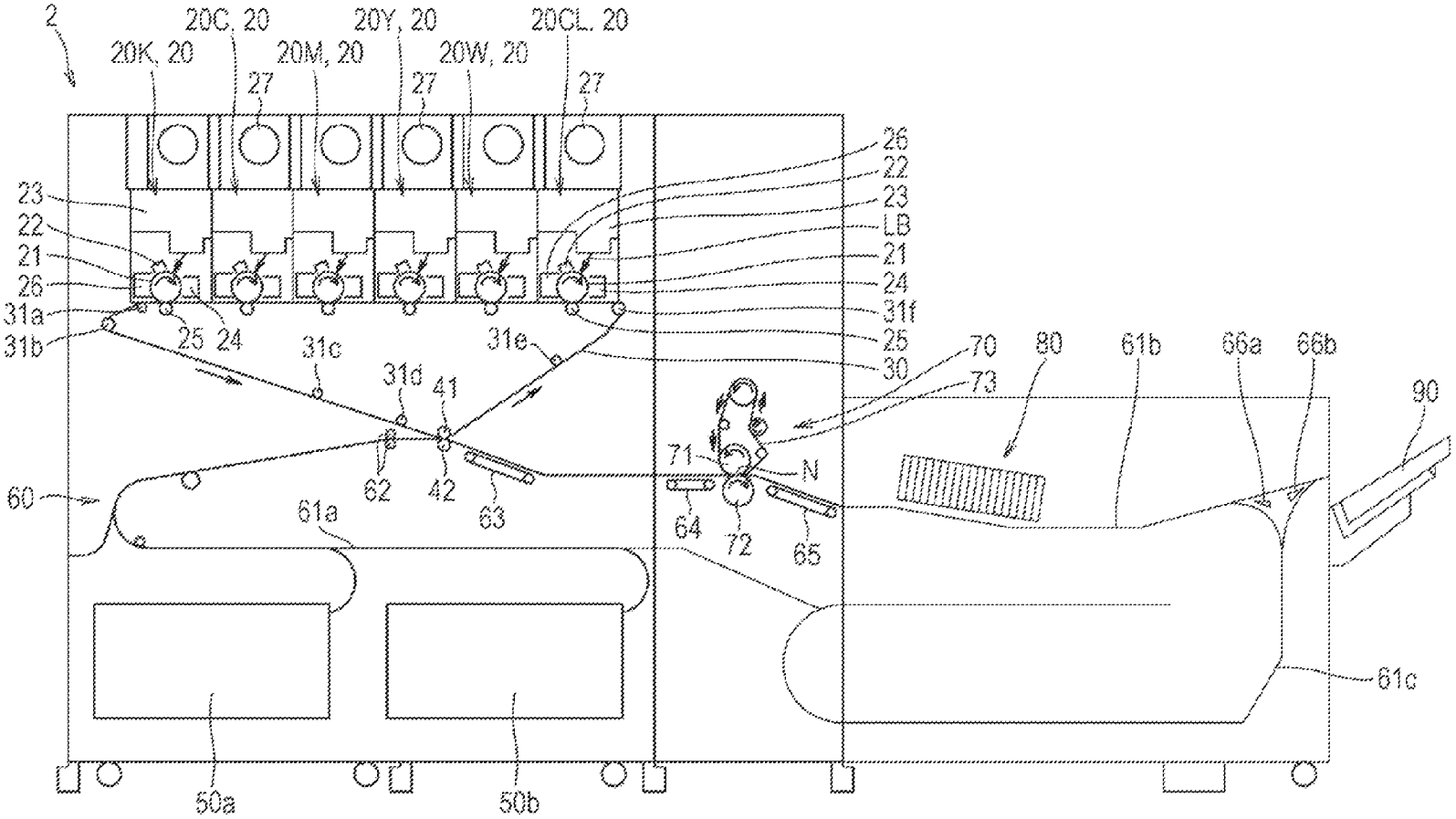
FIG. 3 illustrates an example of an image forming apparatus of the image forming system illustrated in FIG. 1.

FIG. 3 illustrates an example of the image forming apparatus 2 of the image forming system 1 illustrated in FIG. 1. FIG. 3 illustrates a mechanical system of the image forming apparatus 2 and omits illustration of the image processing device 2A and the controller 2BC.

The image forming apparatus 2 according to the first exemplary embodiment is, for example, a tandem color printer.

The image forming apparatus 2 includes multiple image forming units 20, an intermediate transfer belt 30, a backup roller 41 and a second transfer roller 42 that form a pair, sheet supply units 50*a* and 50*b*, a sheet transporting system 60, a fixing device (an example of a fixing unit) 70, a cooling device 80, and a sheet output tray 90.

The image forming units 20 include image forming units 20Y, 20M, 20C, and 20K for four colors, an image forming unit 20W for a white color, and an image forming unit 20CL for a transparent color. The image forming units 20Y, 20M, 20C, and 20K form toner images using toners (an example of developers) of, for example, yellow, magenta, cyan, and black, respectively. The image forming unit 20W transfers a toner image of white, for example. The image forming unit 20CL transfers a toner image of a transparent color. The images formed in accordance with pieces of image data of the individual colors are subjected to first transfer and are transferred onto the intermediate transfer belt 30. Instead of toner of a white color, toner of a gold color or a silver color, for example, may be used.

The six image forming units 20CL, 20W, 20Y, 20M, 20C, and 20K are arranged in an order of a transparent color, white, yellow, magenta, cyan, and black along a direction in which the intermediate transfer belt 30 rotates.

Each of the image forming units 20 includes a photoconductor drum 21, a charging device 22, an exposure device 23, a developing device 24, a first transfer roller 25, and a drum cleaner 26. The charging device 22 charges the surface of the corresponding photoconductor drum 21 to a specific potential. The exposure device 23 irradiates the corresponding charged photoconductor drum 21 with a laser beam LB to form an electrostatic latent image. The developing device 24 develops the electrostatic latent image on the corresponding photoconductor drum 21 to form a toner image. The first transfer roller 25 transfers the toner image carried on the corresponding photoconductor drum 21 onto the intermediate transfer belt 30 at a first transfer section. The drum cleaner 26 removes residual toner or paper powder from the surface of the corresponding photoconductor drum 21 after the toner image has been transferred. Above each of the image forming units 20, there is disposed a toner cartridge 27 that supplies toner of a corresponding color to the corresponding developing device 24.

The first transfer rollers 25 of the corresponding image forming units 20 are disposed so that the intermediate transfer belt 30 is held by the first transfer rollers 25 and the corresponding photoconductor drums 21. Application of a transfer bias voltage having a polarity opposite to a charging polarity of toner to the individual first transfer rollers 25 generates electric fields between the photoconductor drums 21 and the corresponding first transfer rollers 25. As a result, the charged toner images on the corresponding photoconductor drums 21 are transferred onto the intermediate transfer belt 30 by Coulomb force. During the first transfer, the photoconductor drums 21 rotate clockwise.

The intermediate transfer belt 30 is a member that holds toner images of individual color components that are formed by the corresponding image forming units 20 and are successively transferred thereon during the first transfer. The intermediate transfer belt 30 is an endless belt that is stretched around multiple supporting rollers 31*a* to 31*f* and the backup roller 41. The intermediate transfer belt 30 undergoes first transfer of the toner images that are formed by the corresponding image forming units 20CL, 20W, 20Y, 20M, 20C, and 20K, while rotating in a circumferential direction counterclockwise.

The backup roller 41 and the second transfer roller 42 that form a pair implement a mechanism for forming a full-color image by collectively transferring (performing second transfer of) the toner images, which have been transferred on the intermediate transfer belt 30 to be superimposed one another, onto a transparent film or the like. The backup roller 41 and the second transfer roller 42 are disposed so as to oppose each other with the intermediate transfer belt 30 interposed therebetween. A portion where the backup roller 41 and the second transfer roller 42 oppose each other is a second transfer section.

The backup roller 41 is rotatably disposed on the back side of the intermediate transfer belt 30. The second transfer roller 42 is rotatably disposed so as to oppose a toner-image transfer surface of the intermediate transfer belt 30. The backup roller 41 and the second transfer roller 42 are disposed so that their rotational axes (that is, directions perpendicular to the plane of FIG. 3) coincide with each other.

During transfer of the toner images onto the intermediate transfer belt 30, a voltage having a polarity that is the same as a charging polarity of toners is applied to the backup roller 41 or a voltage having a polarity that is opposite to the charging polarity of toners is applied to the second transfer roller 42. This generates a transfer electric field between the backup roller 41 and the second transfer roller 42, and consequently unfixed toner images held on the intermediate transfer belt 30 are transferred onto a transparent film or the like.

The sheet supply units 50*a* and 50*b* each contain transparent films. Each transparent film contained in the sheet supply units 50*a* and 50*b* is picked up by a pickup roller (not illustrated) of the sheet transporting system 60, and is then transported along a transportation path 61*a* of the sheet transporting system 60 to reach registration rollers 62 of the sheet transporting system 60. After the registration rollers 62 adjust the sheet transportation timing, the transparent film is fed to the second transfer section where the toner images are transferred onto the transparent sheet.

The transparent film or the like having the toner image thereon is transported to the fixing device 70 by transportation belts 63 and 64 of the sheet transporting system 60. The fixing device 70 is a device that uses heat and pressure to fix an unfixed image having been transferred on the transparent film or the like in the second transfer section. Herein, the fixing device 70 applies heat using a belt, for example. The fixing device 70 includes a heating roller 71, a pressing roller 72 disposed to oppose the heating roller 71, and a heating belt 73 provided to pass through a fixing nip N between the heating roller 71 and the pressing roller 72.

The transparent film or the like having undergone the second transfer is transported to the fixing nip N, where the transparent film or the like is heated by the heating roller 71 and the heating belt 73 and is pressed by the pressing roller 72. In this way, the unfixed image on the transparent film or the like is fixed. Note that the fixing device 70 is not limited to the above-described one and may be, for example, a fixing device including a heating roller and a pressing roller that oppose each other.

The transparent film or the like having undergone the fixing process is transported to the cooling device 80 by a transportation belt 65 of the sheet transporting system 60. The cooling device 80 is a device that cools the transparent film or the like having undergone the fixing process. Herein, the cooling device 80 includes a radiating fin, for example.

The cooled transparent film or the like is discharged to the sheet output tray 90, outside the image forming apparatus 2, along a transportation path 61*b* of the sheet transporting system 60. Transportation path switches 66*a* and 66*b* are disposed on the transportation downstream side of the transportation path 61*b* and on the transportation upstream side of the sheet output tray 90 from the transportation upstream side to the transportation downstream side.

The transportation path switch 66*a* located on the transportation upstream side changes the path so that the transparent film or the like is transported from the transportation path 61*b* to a reverse path 61*c* in the case where images are formed on both sides of the transparent film or the like. Specifically, the transparent film or the like is transported from the transportation path 61*b* to the reverse path 61*c* by the transportation path switch 66*a*, is returned to the transportation path 61*a*, and is again transported to the second transfer section. In this case, at the second transfer section, an image is transferred onto the back side of the surface of the transparent film or the like on which an image has already been fixed.

The transportation path switch 66*b* on the transportation downstream side changes the path so that a transparent film or the like is transported from the transportation path 61*b* to the reverse path 61*c* in the case where an image is superposed on an already fixed image on a side of the transparent film or the like. Specifically, a transparent film or the like is discharged along the transportation path 61*b* to the sheet output tray 90 except for a trailing part, is transported along the reverse path 61*c* by the transportation path switch 66*b*, is returned to the transportation path 61*a*, and is again transported to the second transfer section. In this case, at the second transfer section, an image is transferred onto the side of the transparent film or the like so as to be superposed on an image already fixed thereon.

Figure 4:
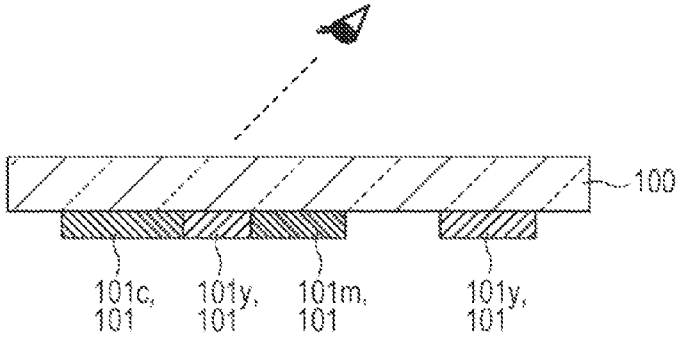
FIG. 4 is a sectional view of a portion of a transparent film that has undergone an ordinary image forming process.
Figure 5:
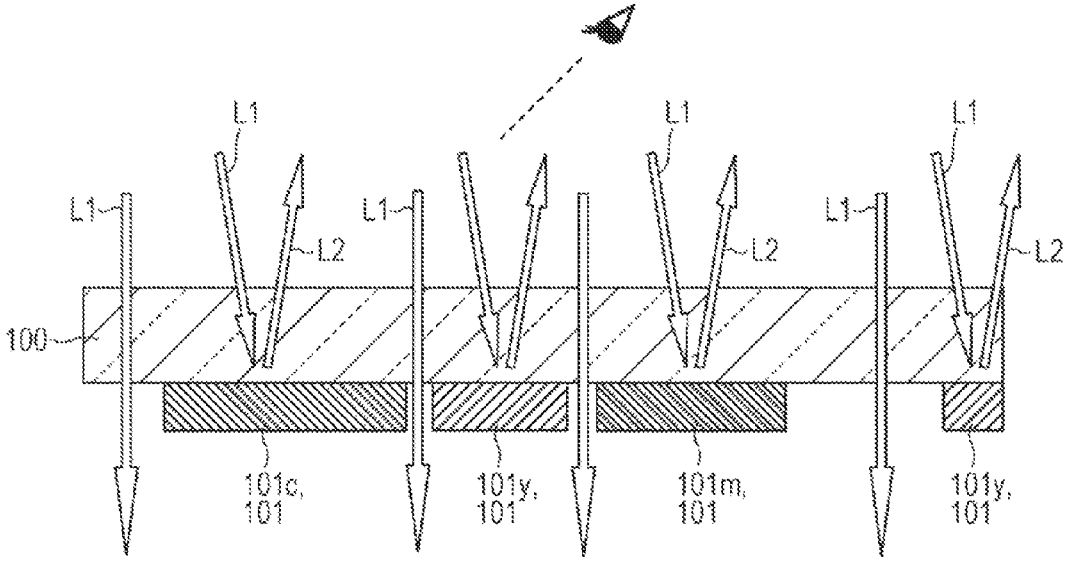
FIG. 5 is an enlarged sectional view of the portion of the transparent film illustrated in FIG. 4.
Figure 6:
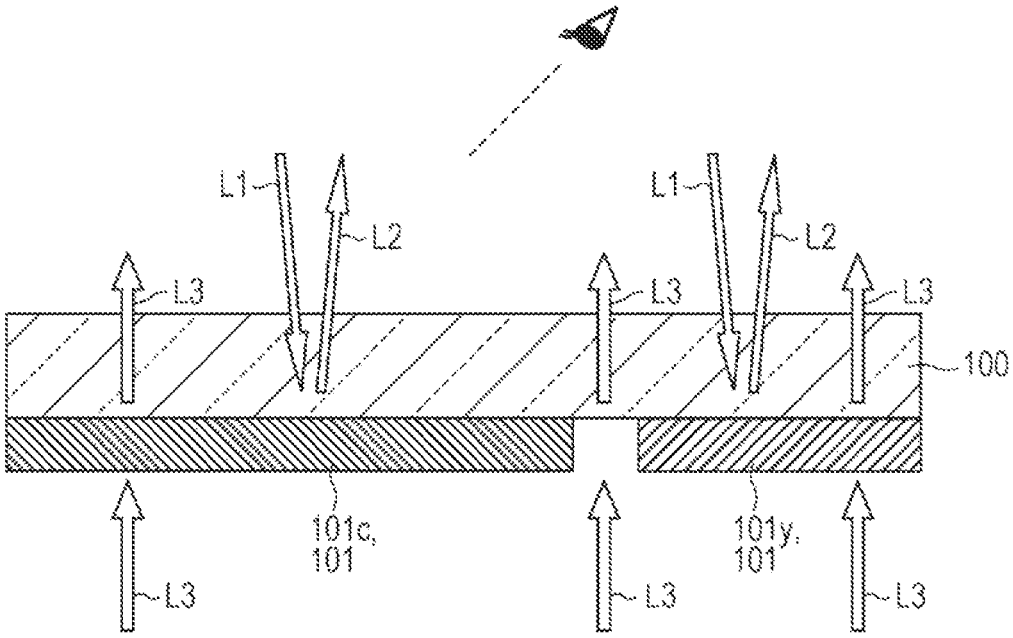
FIG. 6 is an enlarged sectional view of the portion of the transparent film illustrated in FIG. 4.

FIG. 4 is a sectional view of a portion of a transparent film 100 that has undergone an ordinary image forming process, whereas FIGS. 5 and 6 are enlarged sectional views of the portion of the transparent film 100 illustrated in FIG. 4.

The transparent film (an example of a transparent recording medium) 100 illustrated in FIGS. 4 to 6 has a first surface and a second surface that is the back side of the first surface. On the second surface, an image 101 (sub-images 101*y*, 101*m*, and 101*c*) is formed using toners of respective colors. In FIGS. 4 and 5, hatching patterns are changed in accordance with the colors of the image 101. For example, the sub-image 101*y*, the sub-image 101*m*, and the sub-image 101*c* are formed with toners of yellow, magenta, and cyan, respectively.

As illustrated in FIG. 5, rays L1 incident on the first surface of the transparent film 100 pass through the transparent film 100 and hit the image 101 formed on the second surface. As a result, the rays L1 are (regularly and irregularly) reflected by the image 101 as rays L2. Through the rays L2, the image 101 is recognized. However, in some cases, some of the rays L1 that have hit the image 101 pass through the image 101 or pass through boundary portions between the adjacent sub-images 101*c*, 101*y*, and 101*m* of the corresponding colors where toner densities are low. In either case, the image 101 becomes unclear.

Also, as illustrated in FIG. 6, in the case where the image 101 is formed on the transparent film 100 in an ordinary manner, rays L3 incident on the second surface of the transparent film 100 sometimes pass through the image 101, causing the image 101 to appear to be transparent (giving an impression that the image 101 is transparent). As a result, the color forming property of the image 101 is lowered.

Figure 7:
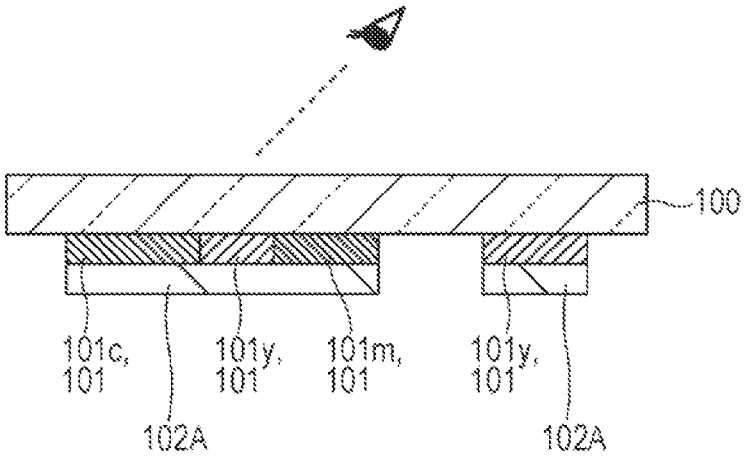
FIG. 7 is a sectional view of a portion of a transparent film that has undergone an image forming process according to a first exemplary embodiment of the present invention.
Figure 8:
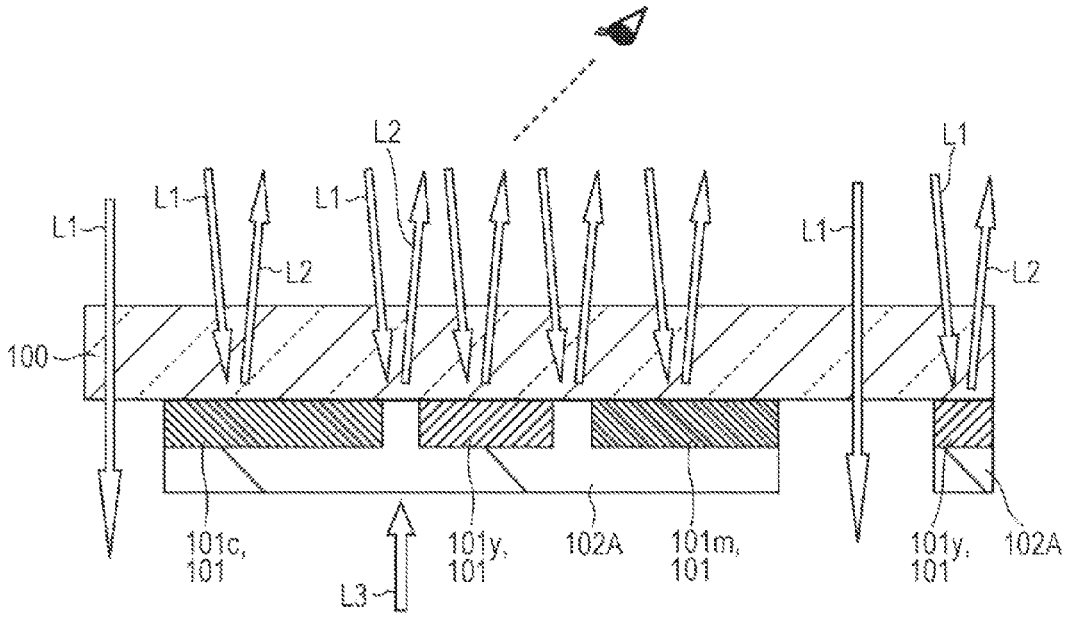
FIG. 8 is an enlarged sectional view of the portion of the transparent film illustrated in FIG. 7.

Accordingly, in the first exemplary embodiment, the transparent film 100 is configured in the following manner. FIG. 7 is a sectional view of a portion of the transparent film 100 that has undergone an image forming process according to the first exemplary embodiment of the present invention. FIG. 8 is an enlarged sectional view of the portion of the transparent film 100 illustrated in FIG. 7.

The transparent film (an example of a transparent recording medium) 100 illustrated in FIGS. 7 and 8 is used as, for example, a shrink label or an in-mold label. The transparent film 100 is made of a transparent substrate, for example, polyvinyl chloride, polypropylene, polyethylene, polystyrene, polyolefin, or polyethylene terephthalate. The transparent film 100 has a first surface which is a side from which an image is visually recognized, and a second surface which is the back side of the first surface.

On the second surface of the transparent film 100, the image 101 (sub-images 101*y*, 101*m*, and 101*c*) is formed using the aforementioned toners. In FIGS. 7 and 8, hatching patterns are changed in accordance with the colors of the image 101.

In the first exemplary embodiment, a light-shielding layer 102A is formed on the second surface of the transparent film 100 so as to be superposed on the image 101. The light-shielding layer 102A is substantially impervious to light and is formed using toner of a color, such as white, gold, or silver, having a brightness and a reflection factor that are higher than those of black and other colors that absorb light. With this configuration, the light-shielding property of the light-shielding layer 102A is improved compared to the case where toner of another color is used.

Also, the light-shielding layer 102A is formed to have a rougher surface than an ordinary toner image (for example, the image 101). The ordinary toner image (for example, the image 101) has a surface roughness of, for example, 3 μm or more and 10 μm or less or about 3 μm or more and about 10 μm or less; and may have a surface roughness of, for example, 5 μm. In contrast, the light-shielding layer 102A has a surface roughness of, for example, 10 μm or more and 30 μm or less or about 10 μm or more and about 30 μm or less; and may have a surface roughness of, for example, 20 μm. With this configuration, the light-shielding property of the light-shielding layer 102A is improved. Note that the term "surface roughness" used herein refers to an "arithmetic average roughness Ra" defined by Japanese Industrial Standards (JIS).

In the first exemplary embodiment, as illustrated in FIG. 8, if some of rays L1, which have passed through the transparent film 100 from the first surface side of the transparent film 100 and have hit the image 101 on the second surface, pass through the image 101, some of the rays L1 hit the light-shielding layer 102A and are partially (regularly and/or irregularly) reflected by the light-shielding layer 102A. Also, if the rays L1 incident on the first surface of the transparent film 100 partially pass through boundary portions between the adjacent sub-images 101*c*, 101*y*, and 101*m* of the corresponding colors where the color densities are low, the rays L1 hit the light-shielding layer 102A and are partially (regularly and/or irregularly) reflected by the light-shielding layer 102A. Moreover, rays L3 incident on the second surface of the transparent film 100 are also reflected by the light-shielding layer 102A. These suppress the image 101 from appearing to be transparent when the image 101 is seen through the transparent film 100. Thus, the overall color forming property of the image 101 is improved, compared to the case where the light-shielding layer 102A is not formed.

Toner used to form the light-shielding layer 102A is generally used by the image forming apparatus 2. Thus, formation of the light-shielding layer 102A does not complicate the configuration of the image forming apparatus 2.

Also, the image 101 is protected by the light-shielding layer 102A and the transparent film 100. Thus, damage or pealing of the image 101 is at least suppressed.

Figure 9:
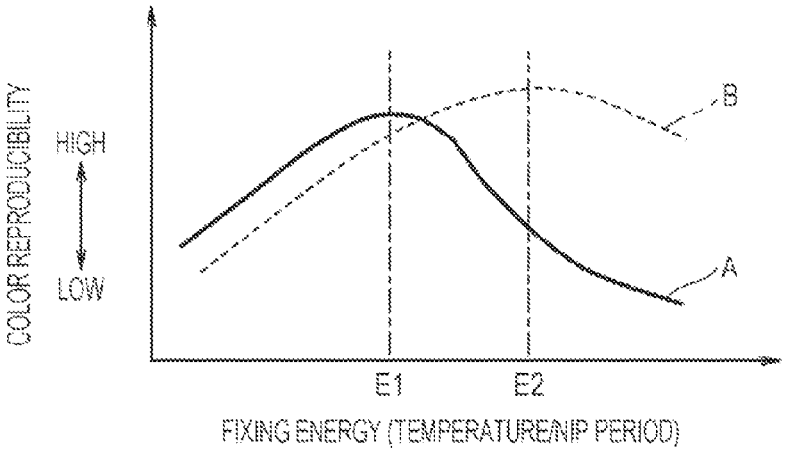
FIG. 9 is a graph illustrating a relationship between color reproducibility and fixing energy used in a fixing process for a transparent film onto which a light-shielding layer has been transferred and for a transparent film onto which a light-shielding layer has not been transferred.

FIG. 9 is a graph illustrating a relationship between color reproducibility and fixing energy used in a fixing process for the transparent film 100 onto which the light-shielding layer 102A has been transferred and for the transparent film 100 onto which the light-shielding layer 102A has not been transferred.

A solid line A denotes a result regarding the transparent film 100 with the light-shielding layer 102A, whereas a dashed line B denotes a result regarding the transparent film 100 without the light-shielding layer 102A. FIG. 9 indicates that a fixing energy E1 that gives a high color reproducibility value for the transparent film 100 with the light-shielding layer 102A is lower than a fixing energy E2 that gives a high color reproducibility value for the transparent film 100 without the light-shielding layer 102A.

Figure 10A:
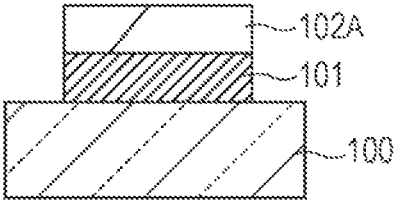
Figure 10B:
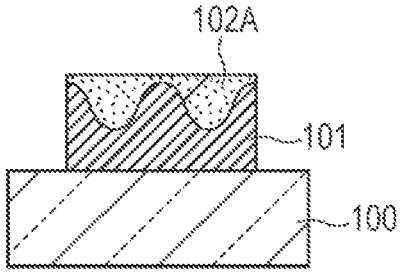
FIG. 10B is a sectional view of a portion of a transparent film with a light-shielding layer, the transparent film having undergone a fixing process in which a fixing energy E2 is used.

FIG. 10A is a sectional view of a portion of the transparent film 100 with the light-shielding layer 102A, the transparent film 100 having undergone a fixing process in which the fixing energy E1 is used. FIG. 10B is a sectional view of the portion of the transparent film 100 with the light-shielding layer 102A, the transparent film 100 having undergone a fixing process in which the fixing energy E2 is used As illustrated in FIG. 10A, in the case where a fixing process is performed on the transparent film 100 at the fixing energy E1, the image 101 and the light-shielding layer 102A are maintained as separate layers after the fixing process. In contrast, as illustrated in FIG. 10B, in the case where a fixing process is performed on the transparent film 100 at the fixing energy E2, toners of the image 101 and of the light-shielding layer 102A are mixed together, making the image 101 unclear.

Figure 11:
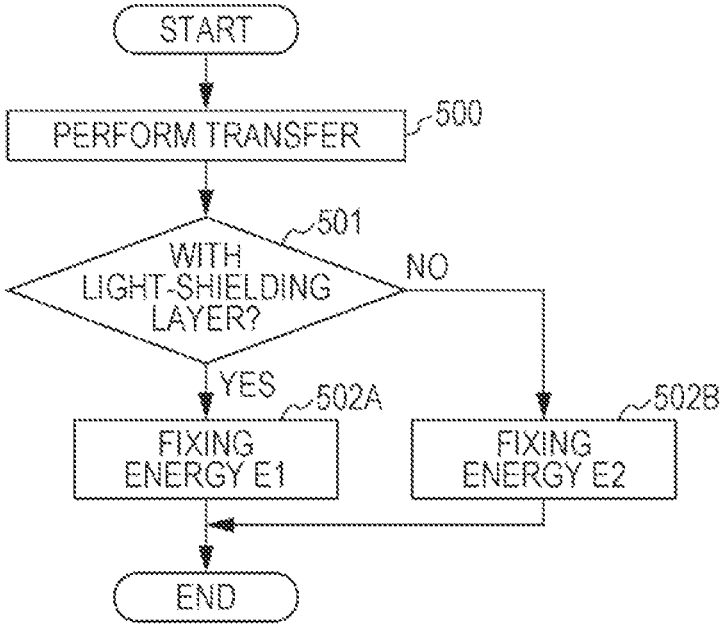
FIG. 11 is a flowchart of an example of the image forming process according to the first exemplary embodiment of the present invention.

Accordingly, in the first exemplary embodiment, a fixing energy used for the transparent film 100 with the light-shielding layer 102A is set to be lower than a fixing energy used for the transparent film 100 without the light-shielding layer 102A. This will be described with reference to a flowchart regarding an example of the image forming process illustrated in FIG. 11.

First, the image 101 is transferred and formed on the transparent film 100 (step 500). The light-shielding layer 102A is optionally formed on the transparent film 100.

Then, whether or not the light-shielding layer 102A is present is determined (step 501). The presence or absence of the light-shielding layer 102A is determined on the basis of image data that is sent to the image processing device 2A in the above-described manner.

If the light-shielding layer 102A has been formed, a fixing process is performed on the transparent film 100 at the fixing energy E1 (step 502A). This fixing energy E1 is set to be lower than the fixing energy E2 used in a fixing process performed on the transparent film 100 without the light-shielding layer 102A. This fixing energy E1 is achieved by making a fixing temperature or a fixing pressure lower or a fixing period shorter than that for the transparent film 100 without the light-shielding layer 102A. Alternatively, two or more above factors may be changed in combination. For example, the fixing energy may be controlled to ultimately decrease by making at least one of temperature, pressure, and a time period decrease while making the rest of the factors increase, such as making the fixing period shorter while keeping the temperature and pressure, thereby lowering the fixing energy.

As described above, by performing a fixing process on the transparent film 100 with the light-shielding layer 102A at the fixing energy E1 which is lower than the fixing energy E2, mixing of the light-shielding layer 102A and the image 101 is at least suppressed. Thus, the color reproducibility of the image 101 formed on the transparent film 100 together with the light-shielding layer 102A is improved, compared to the case where a fixing process is performed at the higher fixing energy E2.

Also, by performing a fixing process on the transparent film 100 with the light-shielding layer 102A at the fixing energy E1 which is lower than the fixing energy E2, the light-shielding layer 102A is maintained as a separate layer and the surface of the light-shielding layer 102A becomes rougher than that of the light-shielding layer 102A on which a fixed process is performed at the higher fixing energy E2. The rougher surface results in the decreased surface gloss level and the decreased transparency (that is, the improved light-shielding property) of the light-shielding layer 102A. For this reason, when the image 101 is seen from the first surface side of the transparent film 100 through the transparent film 100, the degree at which the light-shielding layer 102A shields light becomes a preferable state in terms of suppressing the image 101 from appearing to be transparent when the image 101 is seen from the first surface side of the transparent film 100 through the transparent film 100. Thus, the overall color forming property of the image 101 is improved, compared to the case where the light-shielding layer 102A is not formed.

Referring back to FIG. 11, if the light-shielding layer 102A is absent in step 501, a fixing process is performed on the transparent film 100 at the fixing energy E2 (step 502B).

As described above, by performing a fixing process on the transparent film 100 without the light-shielding layer 102A at the fixing energy E2 which is higher than the fixing energy E1, toners of the image 101 are melted better, making the surface of the image 101 smoother and thus raising the gloss level of the surface of the image 101, compared to the case where a fixing process is performed at the lower fixing energy E1. Accordingly, the image quality and the color reproducibility of the image 101 formed on the transparent film 100 are improved.

Thereafter, the image forming process for the transparent film 100 ends. The above has described both a case where the image forming apparatus 2 forms the light-shielding layer 102A on the transparent film 100 on which an image has been formed and a case where the image forming apparatus 2 does not form the light-shielding layer 102A during an image forming process; however, the above flowchart is not limitedly applied to such cases.

Specifically, the above flowchart is also applied to a case where the image forming apparatus 2 performs an image forming process only for the transparent film 100 with the light-shielding layer 102A (that is, a case where no transparent film 100 without the light-shielding layer 102A is transported). In this case, a fixing process is performed on the transparent film 100 with the light-shielding layer 102A at the lower fixing energy E1 (which is lower than the fixing energy E2 that is usually applied to fix an image on the transparent film 100 without the light-shielding layer 102A). With this configuration, the above-described advantages are provided for the transparent film 100 with the light-shielding layer 102A.

Referring now to FIGS. 3, 12 to 16, and so forth, an example of a method for forming the image 101 and the light-shielding layer 102A on the second surface of the transparent film 100 will be described.

Figure 12:
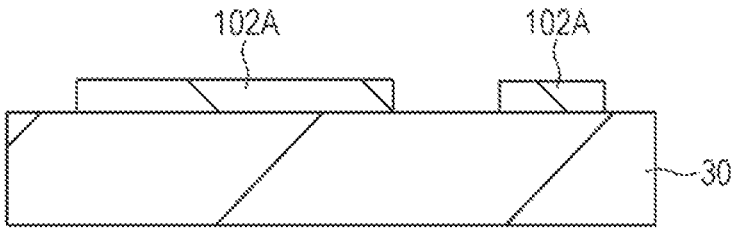
FIG. 12 is a sectional view of a portion of an intermediate transfer belt of the image forming apparatus illustrated in FIG. 3 during the image forming process performed to obtain the transparent film illustrated in FIG. 7.
Figure 13:
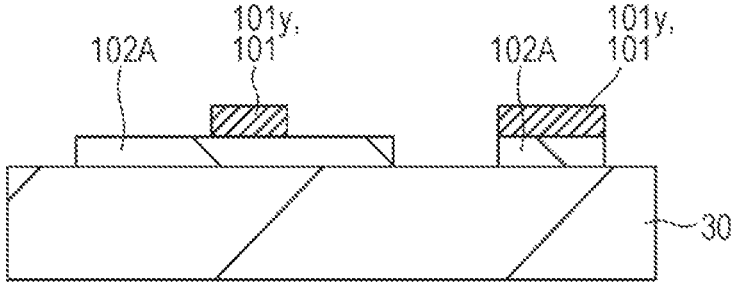
FIG. 13, which follows
Figure 14:
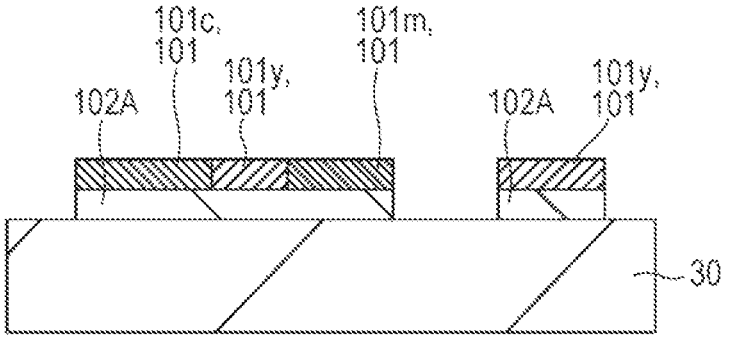
FIG. 14, which follows

First, as illustrated in FIG. 12, for example, the light-shielding layer 102A of a white color is transferred by the image forming unit 20W onto a transfer area of the intermediate transfer belt 30 of the image forming apparatus 2 (see, for example, FIG. 3). Subsequently, the intermediate transfer belt 30 is moved so that the transfer area is positioned under the image forming unit 20Y. Then, as illustrated in FIG. 13, for example, the sub-image 101*y* of yellow toner is transferred by the image forming unit 20Y on the light-shielding layer 102A. Then, the intermediate transfer belt 30 is moved so that the transfer area is sequentially positioned under the image forming units 20M and 20C. As illustrated in FIG. 14, for example, the sub-image 101*m* of magenta toner and the sub-image 101*c* of cyan toner are sequentially transferred on the light-shielding layer 102A by the image forming units 20M and 20C, respectively.

Figure 15:
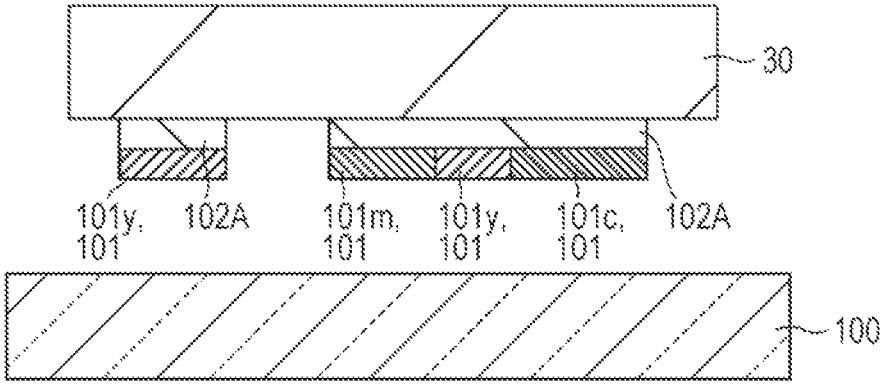
FIG. 15, which follows
Figure 16:
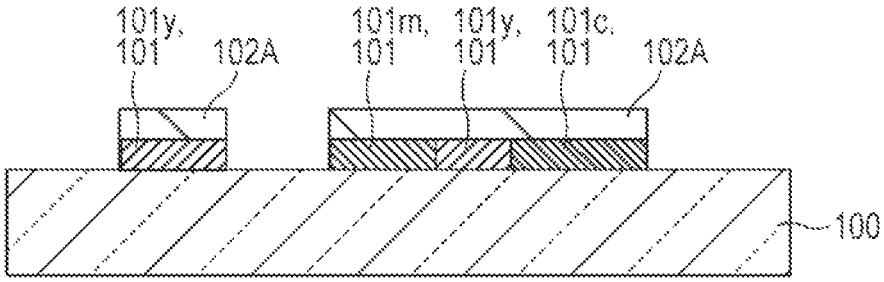
FIG. 16, which follows

Subsequently, as illustrated in FIG. 15, the transfer area of the intermediate transfer belt 30 is moved to the second transfer section. In addition to this, the transparent film 100 is transported by the registration rollers 62 so that the transparent film 100 reaches the second transfer section substantially at the same time as the transfer area. Then, as illustrated in FIG. 16, the light-shielding layer 102A and the image 101 on the intermediate transfer belt 30 are transferred onto the second surface of the transparent film 100.

Thereafter, the transparent film 100 on which the light-shielding layer 102A and the image 101 have been formed is transported to the fixing device 70, where the transparent film 100 undergoes a fixing process. At this time, the fixing energy E1 is used which is lower than the fixing energy E2 used for the transparent film 100 only with the image 101 but without the light-shielding layer 102A.

For example, the fixing temperature used for the transparent film 100 with the light-shielding layer 102A is set to be a temperature (for example, 160° C. to 180° C.) that is lower than a temperature (for example, 190° C. to 210° C.) used for the transparent film 100 only with the image 101 but without the light-shielding layer 102A.

Alternatively, a fixing period for the transparent film 100 with the light-shielding layer 102A is set to be a period (for example, 30 milliseconds to 40 milliseconds) that is shorter than a period (for example, 50 milliseconds to 60 milliseconds) for the transparent film 100 only with the image 101 but without the light-shielding layer 102A. Such a fixing period is set by changing the speed at which the transparent film 100 passes through the fixing nip N of the fixing device 70 or by changing the width of the fixing nip N. Note that the fixing energy E1 may be set by changing two or more of the fixing temperature, the fixing pressure, and the fixing period in combination as described above.

Thereafter, the image forming process on the transparent film 100 ends.

Second Exemplary Embodiment

Figure 17:
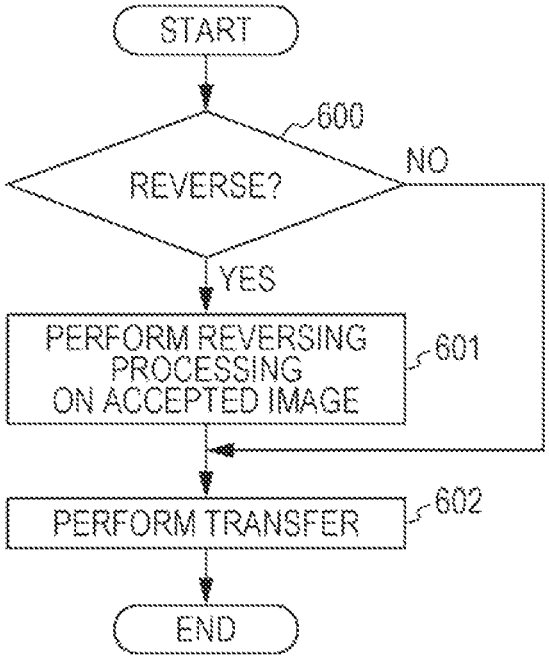
FIG. 17 is a flowchart of an example of an image forming process according to a second exemplary embodiment of the present invention.

FIG. 17 is a flowchart of an example of an image forming process according to a second exemplary embodiment.

In the second exemplary embodiment, it is determined whether or not to reverse an original accepted image that has been accepted, as an image to be transferred onto the transparent film 100, by the image processing device 2A illustrated in FIG. 1 and so forth (step 600). If it is determined that the accepted image is to be reversed, reversing processing is performed on the accepted image (step 601). Then, an image based on data of the reversed image resulting from the reversing processing is transferred (step 602).

If it is determined in step 600 of FIG. 17 that the accepted image is not to be reversed, an image based on data of the original accepted image is transferred onto the transparent film 100 (step 602) without performing reversing processing on the accepted image.

Figure 18:
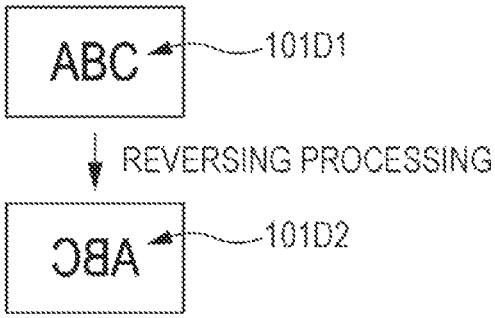
FIG. 18 schematically illustrates an example of reversing processing performed on an accepted image.

FIG. 18 schematically illustrates an example of the reversing processing performed on the accepted image. Specifically, upper part of FIG. 18 schematically illustrates an example of an accepted image 101D1 based on original data that has been accepted as a to-be-formed image by the image processing device 2A illustrated in FIG. 1 and so forth. Also, lower part of FIG. 18 schematically illustrates an example of an image 101D2 based on data obtained by performing reversing processing on the data of the accepted image 101D1.

Figure 19:
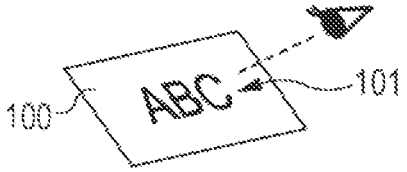
FIG. 19 is a schematic diagram of a transparent film on which an image based on image data resulting from the reversing processing of FIG. 18 has been transferred and fixed.

FIG. 19 is a schematic diagram of the transparent film 100 on which the image 101 based on data of the image 101D2 resulting from the reversing processing of FIG. 18 has been transferred and fixed. As a result of performing reversing processing on the data of the accepted image 101D1, the image 101 seen through the transparent film 100 (the image 101 seen from the first surface side of the transparent film 100) is visually recognized in the same manner as indicated by the original data of the accepted image 101D1 illustrated in FIG. 18.

Third Exemplary Embodiment

Figure 20:
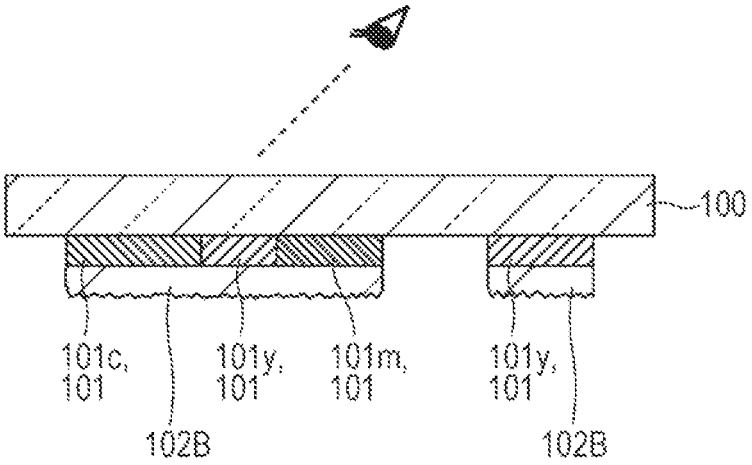
FIG. 20 is a sectional view of a portion of a transparent film that has undergone an image forming process according to a third exemplary embodiment of the present invention.
Figure 21:
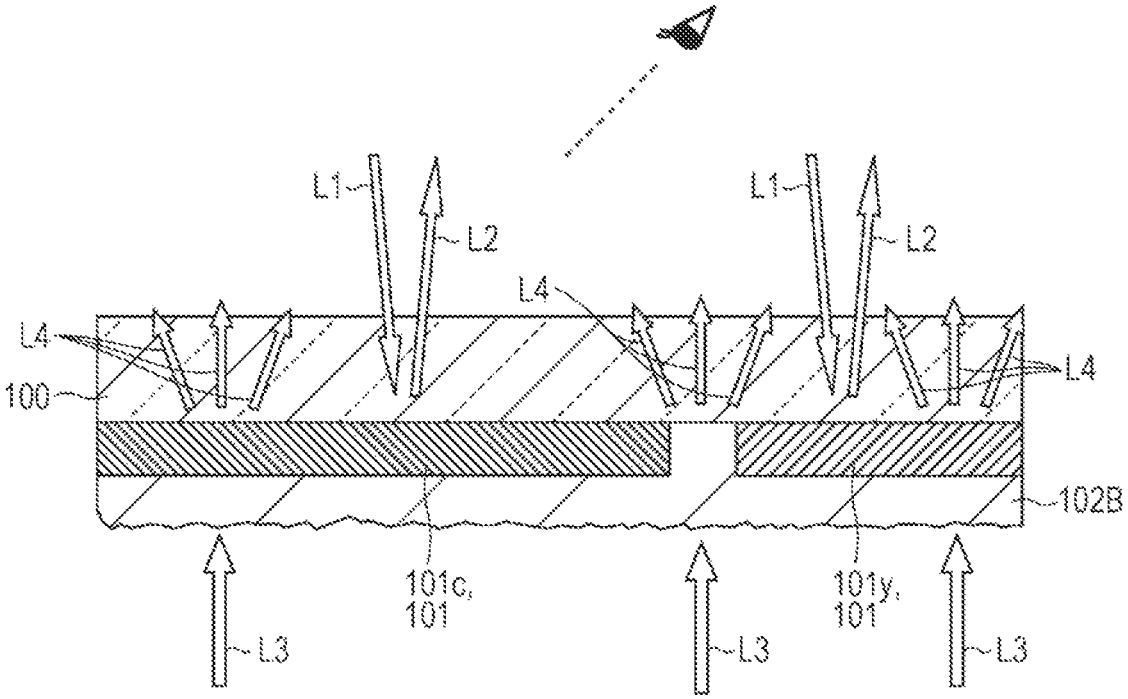
FIG. 21 is an enlarged sectional view of the portion of the transparent film illustrated in FIG. 20.

FIG. 20 is a sectional view of a portion of the transparent film 100 that has undergone an image forming process according to a third exemplary embodiment. FIG. 21 is an enlarged sectional view of the portion of the transparent film 100 illustrated in FIG. 20.

In the third exemplary embodiment, a light-shielding layer 102B is formed so as to be superposed on the image 101 on the second surface of the transparent film 100 using, for example, toner of a transparent color.

In the case where the transparent film 100 is used as a recording medium, the image 101 is sometimes coated with a transparent toner layer for protection because the bond strength of the image 101 fixed to the transparent film 100 is low. Thus, the transparent toner layer is used as a light-shielding layer in some cases or is not in other cases (that is, the transparent toner layer is used as a protection layer that lets light pass therethrough).

In the case where the transparent toner layer is used as the light-shielding layer 102B, it is preferable that the light-shielding property of the light-shielding layer 102B be made higher than that of the image 101 or a transparent toner layer that is not used as a light-shielding layer. This may be achieved, for example, by making the surface of the light-shielding layer 102B rougher than that of an ordinary toner image (for example, the image 101) or a transparent toner layer not used as a light-shielding layer so as to lower the gloss level of the surface of the light-shielding layer 102B; or by making the light-shielding layer 102B thicker than the image 101 or a transparent toner layer not used as a light-shielding layer so as to make the light-shielding property of the light-shielding layer 102B higher; or by using the above methods in combination.

As described above, an ordinary toner image (for example, the image 101) or a transparent toner layer not used as a light-shielding layer has a surface roughness of, for example, 3 μm or more and 10 μm or less, or about 3 pin or more and about 10 μm or less; and may have a surface roughness of, for example, 5 μm. In contrast, the light-shielding layer 102B has a surface roughness of, for example, 10 μm or more and 30 μm or less, or about 10 μm or more and about 30 μm or less; and may have a surface roughness of, for example, 20 μm. With this configuration, the light-shielding property of the light-shielding layer 102B is improved.

The surface roughness of the transparent toner layer may be changed by performing control during a fixing process.

Specifically, the fixing energy is changed between the case where the transparent toner layer is used as a light-shielding layer and the case where the transparent toner layer is not used as a light-shielding layer. For example, in the case where the transparent toner layer is used as the light-shielding layer 102B, the fixing energy used therefor is set to be lower than a fixing energy used for a transparent toner layer not used as a light-shielding layer. This provides different usages of the transparent toner layer: as a protection layer that lets light pass therethrough and as a light-shielding layer that hardly lets light pass therethrough.

FIGS. 20 and 21 illustrate the light-shielding layer 102B that is formed to have a rough surface.

In the third exemplary embodiment, as described in FIG. 8, if some of rays L1, which have passed through the transparent film 100 from the first surface side of the transparent film 100 and have hit the image 101 on the second surface, pass through the image 101, some of the rays L1 hit the light-shielding layer 102B and are partially (regularly and/or irregularly) reflected by the light-shielding layer 102B. Also, if the rays L1 incident on the first surface of the transparent film 100 partially pass through boundary portions between the adjacent sub-images 101*c*, 101*y*, and 101*m* of the corresponding colors where the color densities are low, the rays L1 hit the light-shielding layer 102B and are partially (regularly and/or irregularly) reflected by the light-shielding layer 102B. Moreover, as illustrated in FIG. 21, rays L3 incident on the second surface of the transparent film 100 are diffused by the light-shielding layer 102B as indicated by rays L4. These suppress the image 101 from appearing to be transparent when the image 101 is seen from the first surface side of the transparent film 100 through the transparent film 100. Thus, the overall color forming property of the image 101 is improved compared to the case where the light-shielding layer 102B is not formed.

Toner used to form the light-shielding layer 102B is generally used by the image forming apparatus 2. Thus, formation of the light-shielding layer 102B does not complicate the configuration of the image forming apparatus 2.

Also, the image 101 is protected by the light-shielding layer 102B and the transparent film 100. Thus, damage or pealing of the image 101 is at least suppressed.

In Japanese Unexamined Patent Application Publication No. 2010-107540 in which a transparent protection layer is formed on a color image formed on an image support, the color image is visually recognized through the transparent protection layer. For this reason, the surface of the transparent protection layer is highly flat to suppress light-scattering and transparency of the transparent protection layer is ensured. Accordingly, the transparent protection layer of Japanese Unexamined Patent Application Publication No. 2010-107540 is used only as a protection layer and thus is different from the light-shielding layer 102B of the third exemplary embodiment.

Referring now to FIGS. 3 and 22 to 27, an example of a method for forming the image 101 and the light-shielding layer 102B on the second surface of the transparent film 100 will be described.

Figure 22:
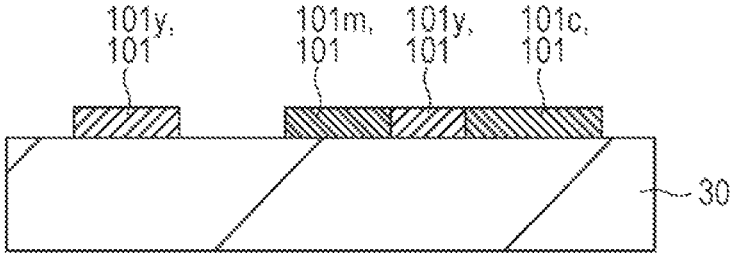
FIG. 22 is a sectional view of a portion of the intermediate transfer belt of the image forming apparatus illustrated in FIG. 3 during the image forming process performed to obtain the transparent film illustrated in FIG. 20.

First, as illustrated in FIG. 22, for example, the sub-image 101*y* of yellow toner, the sub-image 101*m* of magenta toner, and a sub-image 101*c* of cyan toner are sequentially transferred onto a transfer area of the intermediate transfer belt 30 of the image forming apparatus 2 (see FIG. 3).

Figure 23:
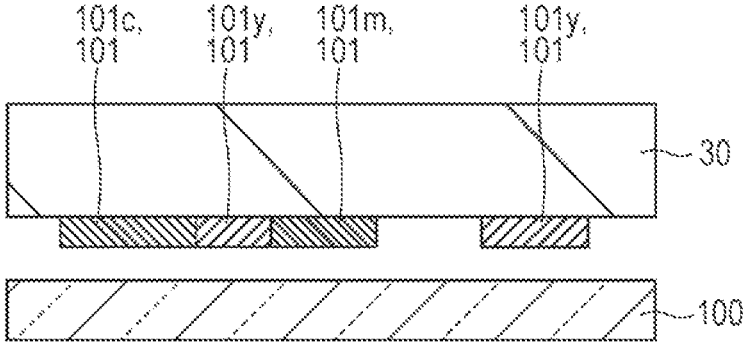
FIG. 23, which follows
Figure 24:
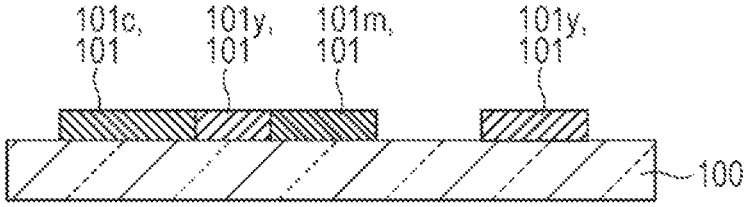
FIG. 24, which follows

Subsequently, as illustrated in FIG. 23, the transfer area of the intermediate transfer belt 30 is moved to the second transfer section. In addition to this, the transparent film 100 is transported by the registration rollers 62 so that the transparent film 100 reaches the second transfer section substantially at the same time as the transfer area. Then, as illustrated in FIG. 24, the image 101 on the intermediate transfer belt 30 is transferred onto the second surface of the transparent film 100.

Thereafter, the transparent film 100 on which the image 101 has been transferred is transported to the fixing device 70 of the image forming apparatus 2 illustrated in FIG. 3, and the fixing device 70 performs a fixing process on the transparent film 100. In this fixing process, the fixing energy E2 (a fixing temperature, a fixing pressure, and a fixing period), which is for a transparent film without a light-shielding layer, is used to fix the image 101 on the transparent film 100. In this case, toners of the image 101 are melted better, making the surface of the image 101 smoother and thus raising the gloss level of the surface of the image 101, compared to the case where a fixing process is performed at the lower fixing energy E1. Accordingly, the image quality and the color reproducibility of the image 101 formed on the transparent film 100 are improved, compared to the case where a fixing process is performed at the lower fixing energy E1.

Subsequently, the transparent film 100 having undergone the fixing process is transported along the transportation path 61*b* of the image forming apparatus 2 illustrated in FIG. 3, passes through the cooling device 80, is transported by the transportation path switch 66*b* from the transportation path 61*b* to the reverse path 61*c*, and is fed back to the transportation path 61*a*.

Figure 25:
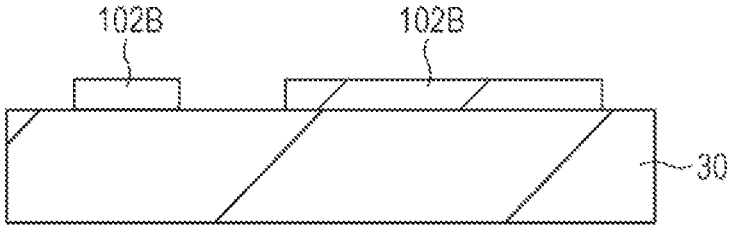
FIG. 25, which follows
Figure 26:
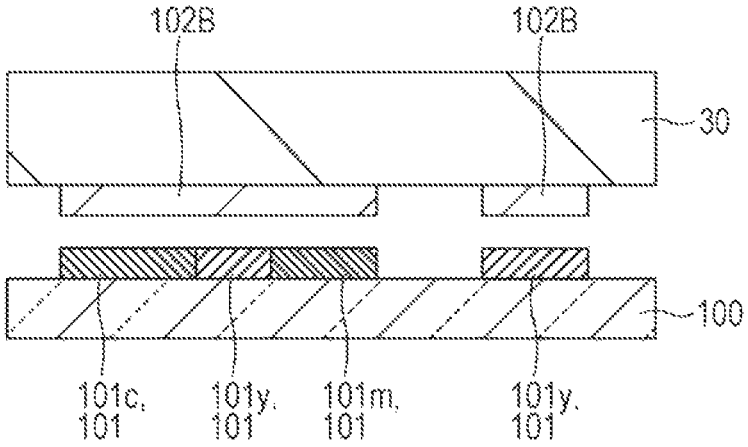
FIG. 26, which follows
Figure 27:
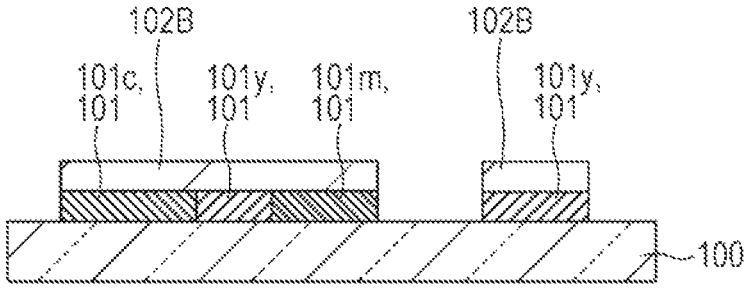
FIG. 27, which follows

At this time, as illustrated in FIG. 25, the light-shielding layer 102B of transparent toner is transferred by the image forming unit 20CL onto the transfer area of the intermediate transfer belt 30 of the image forming apparatus 2 illustrated in FIG. 3. Subsequently, as illustrated in FIG. 26, the transfer area of the intermediate transfer belt 30 is moved to the second transfer section. In addition to this, the transparent film 100 on which the image 101 has been formed and which is returned to the transportation path 61*a* is transported by the registration rollers 62 so that the transparent film 100 reaches the second transfer section substantially at the same time as the transfer area. Then, as illustrated in FIG. 27, the light-shielding layer 102B on the intermediate transfer belt 30 is transferred so as to be superposed on the image 101 fixed on the second surface of the transparent film 100.

Subsequently, the transparent film 100 on which the light-shielding layer 102B has been transferred is transported to the fixing device 70 of the image forming apparatus 2 illustrated in FIG. 3 and the fixing device 70 performs a fixing process. As described above, the fixing processes are performed separately on the image 101 and on the light-shielding layer 102B. This at least suppresses mixing of the light-shielding layer 102B and the image 101. Accordingly, the color reproducibility of the image 101 formed on the transparent film 100 together with the light-shielding layer 102B is improved, compared to the case where the light-shielding layer 102B and the image 101 are fixed simultaneously at the higher fixing energy E2.

Also, the fixing process for the light-shielding layer 102B uses a fixing energy that is different from that used in the fixing process for the image 101. This makes the surface states (such as surface roughness) of the image 101 and the light-shielding layer 102B different from each other, and makes diffusion, irregular refection, or the like on the individual surfaces different from each other.

That is, the gloss level of the surface is different between the image 101 and the light-shielding layer 102B. In particular, similar to the first exemplary embodiment, a fixing process is performed on the light-shielding layer 102B at the fixing energy E1 that is lower than the fixing energy E2. This makes the surface of the light-shielding layer 102B having undergone the fixing process rougher than the surface of the image 101 or a transparent toner layer that is not used as a light-shielding layer on which the fixing process is performed using the higher fixing energy E2. Accordingly, the gloss level of the surface of the light-shielding layer 102B becomes lower than that of the surface of the image 101 or the transparent toner layer that is not used as a light shielding layer, and the transparency of the light-shielding layer 102B becomes lower than that of the image 101 or the transparent toner layer that is not used as a light-shielding layer (the light-shielding property becomes higher). Accordingly, when the image 101 is seen from the first surface side of the transparent film 100 through the transparent film 100, the degree at which the light-shielding layer 102B shields light becomes a preferable state in terms of suppressing the image 101 from appearing to be transparent, and thus the color forming property of the image 101 is improved compared to the case where the light-shielding layer 102B is not formed.

Moreover, because a contact surface of the image 101 and the light-shielding layer 102B becomes smoother and thus has an increased gloss level as described above, the image quality and the color reproducibility of the image 101 are improved compared to the transparent film 100 with the light-shielding layer 102A of the first exemplary embodiment.

Thereafter, the image forming process performed on the transparent film 100 ends. Note that the light-shielding layer 102B may be formed in the way as described in the first exemplary embodiment. Also, the light-shielding layer 102A described in the first exemplary embodiment may be formed in the way as described in the third exemplary embodiment.

Fourth Exemplary Embodiment

Figure 28:
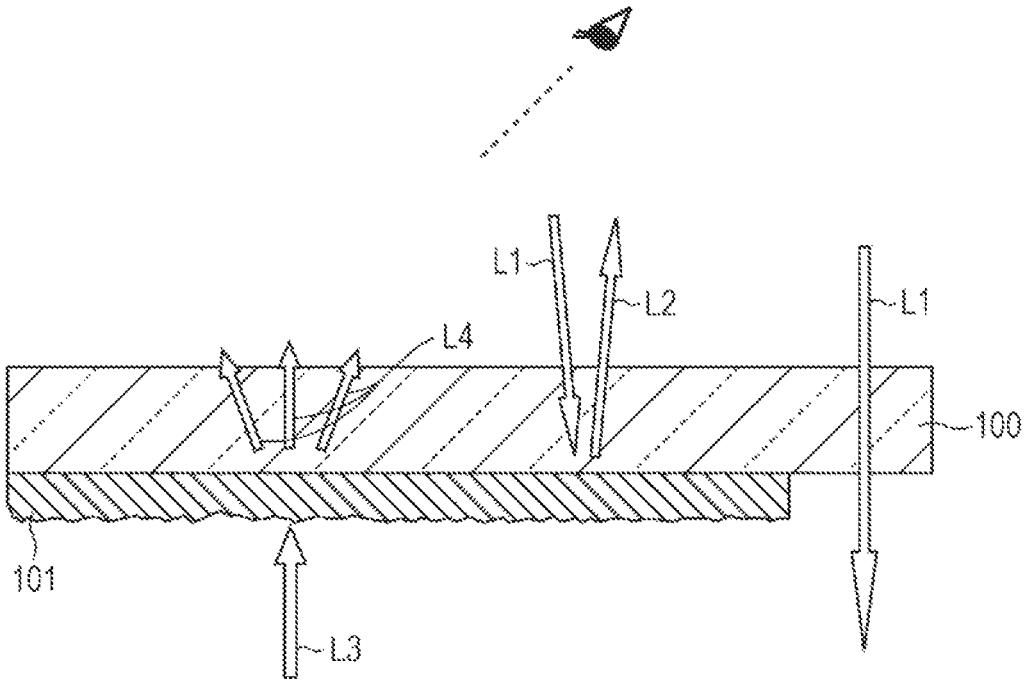
FIG. 28 is a sectional view of a portion of a transparent film that has undergone an image forming process according to a fourth exemplary embodiment of the present invention.

FIG. 28 is a sectional view of a portion of the transparent film 100 that has undergone an image forming process according to a fourth exemplary embodiment.

In the fourth exemplary embodiment, the surface of the image 101 formed on the second surface of the transparent film 100 is rougher than the surface of a predetermined image. As a result, the gloss level of the surface of the image 101 is lower than that of the surface of the predetermined image.

To make the surface of the image 101 rougher, the fixing energy used in a fixing process performed on the image 101 having transferred onto the transparent film 100 is set to be lower than the fixing energy E2. To make the fixing energy lower, for example, a fixing temperature is lowered, a fixing pressure is lowered, or a period of the fixing process is shortened compared to that for the transparent film 100 without a light-shielding layer, as described in the first exemplary embodiment. Alternatively, the two or more above methods may be used in combination. For example, the fixing energy may be controlled to ultimately decrease by making at least one of temperature, pressure, and a time period decrease while making the rest of the factors increase, such as making the fixing period shorter while keeping the temperature and pressure, thereby lowing the fixing energy.

Alternatively, the light-shielding property of the image 101 may be made higher than a predetermined value by making the image 101 thicker than a predetermined thickness or by simultaneously making the image 101 thicker than the predetermined thickness and making the surface of the image 101 rougher than the surface of the predetermined image.

In the fourth exemplary embodiment, as illustrated in FIG. 28, some of rays L1, which have passed through the transparent film 100 from the first surface side of the transparent film 100 and have hit the image 101 on the second surface, are partially (regularly and/or irregularly) reflected as rays L2. Also, rays L3 incident on the second surface of the transparent film 100 are diffused by the image 101 as indicated by rays L4. As a result, the degree at which the image 101 shields light becomes a preferable state in terms of suppressing the image 101 from appearing to be transparent when the image 101 is seen from the first surface side of the transparent film 100 through the transparent film 100. Thus, the overall color forming property of the image 101 is improved compared to the case where processing for improving the light-shielding property of the image 101 is not performed.

Also, because the light-shielding layer 102A or 102B is not needed, the image forming processing speed for the transparent film 100 increases. Also, because an image forming unit for transferring a white, gold, silver, or transparent toner image for forming the light-shielding layer 102A or 102B is not needed, the image forming apparatus 2 has a more simplified configuration and becomes less costly.

While the invention made by the inventor has been specifically described above using the exemplary embodiments, the exemplary embodiments disclosed herein are illustrative only in every aspect and the invention is not limited to the disclosed technique. That is, the technical scope of the present invention is not limitedly interpreted in accordance with the description of the exemplary embodiments but is to be interpreted in accordance with claims. Techniques equivalent to those described in claims and all modifications not deviating from the gist of claims are included.

For example, the exemplary embodiments have described the case of employing an image forming apparatus of an intermediate transfer system in which an image having been transferred onto an intermediate transfer belt is transferred onto a sheet. However, the image forming apparatus is not limited to such an apparatus and an image forming apparatus of a direct transfer system in which toner images on photoconductor drums are directly transferred onto a transparent film or the like may be employed.

Also, the image forming apparatus 2 may be equipped with a sheet output mechanism that reverses the front and back sides of the transparent film 100, so that the transparent film 100 is always output to the sheet output tray 90 with the first side thereof set as the front side.

The above description has been given for the case where the present invention is applied to color printers. The present invention may be applied to other image forming apparatuses, for example, color copiers, fax machines, or image forming apparatuses having functions of these apparatuses.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a fixing unit that performs a fixing process selectively using a first fixing energy and a second fixing energy, the first fixing energy being used for a transparent recording medium having thereon an image and a light-shielding layer superposed on the image, the light-shielding layer being substantially impervious to light, the second fixing energy being used for a transparent recording medium having the image thereon but not having the light-shielding layer thereon, wherein the first fixing energy is lower than the second fixing energy.

2. The image forming apparatus according to claim 1, further comprising:

a controller that selectively switches between the first fixing energy and the second fixing energy.

3. The image forming apparatus according to claim 2, wherein the transparent recording medium has a transparent toner layer thereon, wherein in a case where the transparent toner layer forms the light-shielding layer, the transparent toner layer has a surface roughness of about 10 μm or more and about 30 μm or less, and wherein in a case where the transparent toner layer does not form the light-shielding layer, the transparent toner layer has a surface roughness of about 3 μm or more and about 10 μm or less.

4. The image forming apparatus according to claim 2, wherein the light-shielding layer includes toner of a white color, a gold color, or a silver color.

5. The image forming apparatus according to claim 1, wherein the transparent recording medium has a transparent toner layer thereon, wherein in a case where the transparent toner layer forms the light-shielding layer, the transparent toner layer has a surface roughness of about 10 μm or more and about 30 μm or less, and wherein in a case where the transparent toner layer does not form the light-shielding layer, the transparent toner layer has a surface roughness of about 3 μm or more and about 10 μm or less.

6. The image forming apparatus according to claim 1, wherein the light-shielding layer includes toner of a white color, a gold color, or a silver color.

7. An image forming system comprising:

the image forming apparatus according to claim 1; and an image processing apparatus that is connected to the image forming apparatus via a communication line and that outputs image data to the image forming apparatus via the communication line, wherein the image forming apparatus performs an image forming process in accordance with data obtained by performing reversing processing on the image data received from the image processing apparatus.

8. An image forming apparatus comprising:

a fixing unit that performs a fixing process selectively using a third fixing energy and a fourth fixing energy, the third fixing energy being used for fixing a light-shielding layer that is substantially impervious to light and is formed so as to be superposed on an image on a transparent recording medium, the fourth fixing energy being used for fixing the image, wherein the third fixing energy is lower than the fourth fixing energy.

9. The image forming apparatus according to claim 8, further comprising:

a controller that selectively switches between the third fixing energy and the fourth fixing energy.

10. The image forming apparatus according to claim 9, wherein the transparent recording medium has a transparent toner layer thereon, wherein in a case where the transparent toner layer forms the light-shielding layer, the transparent toner layer has a surface roughness of about 10 μm or more and about 30 μm or less, and wherein in a case where the transparent toner layer does not form the light-shielding layer, the transparent toner layer has a surface roughness of about 3 μm or more and about 10 μm or less.

11. The image forming apparatus according to claim 9, wherein the light-shielding layer includes toner of a white color, a gold color, or a silver color.

12. The image forming apparatus according to claim 8, wherein the transparent recording medium has a transparent toner layer thereon, wherein in a case where the transparent toner layer forms the light-shielding layer, the transparent toner layer has a surface roughness of about 10 μm or more and about 30 μm or less, and wherein in a case where the transparent toner layer does not form the light-shielding layer, the transparent toner layer has a surface roughness of about 3 μm or more and about 10 μm or less.

13. The image forming apparatus according to claim 8, wherein the light-shielding layer includes toner of a white color, a gold color, or a silver color.

14. An image forming system comprising:

the image forming apparatus according to claim 8; and an image processing apparatus that is connected to the image forming apparatus via a communication line and that outputs image data to the image forming apparatus via the communication line, wherein the image forming apparatus performs an image forming process in accordance with data obtained by performing reversing processing on the image data received from the image processing apparatus.

15. A non-transitory computer readable medium storing a program causing a computer to execute a process, the process comprising:

setting a first fixing energy used for a transparent recording medium having thereon an image and a light-shielding layer superposed on the image, the light-shielding layer being substantially impervious to light, to be lower than a second fixing energy used for a transparent recording medium having the image thereon but not having the light-shielding layer thereon.

16. A non-transitory computer readable medium storing a program causing a computer to execute a process, the process comprising:

setting a third fixing energy used for fixing a light-shielding layer, the light-shielding layer being substantially impervious to light and being formed so as to be superposed on an image on a transparent recording medium, to be lower than a fourth fixing energy used for fixing the image.

17. An image forming method comprising:

setting a first fixing energy used for a transparent recording medium having thereon an image and a light-shielding layer superposed on the image, the light-shielding layer being substantially impervious to light, to be lower than a second fixing energy used for a transparent recording medium having the image thereon but not having the light-shielding layer thereon.

* * * * *